US012043503B2

(12) United States Patent
Reimer

(10) Patent No.: US 12,043,503 B2
(45) Date of Patent: Jul. 23, 2024

(54) HOUSE WRAPPING DEVICE

(71) Applicant: Eric Reimer, Rochester, NY (US)

(72) Inventor: Eric Reimer, Rochester, NY (US)

( * ) Notice: Subject to any disclaimer, the term of this patent is extended or adjusted under 35 U.S.C. 154(b) by 229 days.

(21) Appl. No.: 17/677,485

(22) Filed: Feb. 22, 2022

(65) Prior Publication Data

US 2023/0264910 A1 Aug. 24, 2023

(51) Int. Cl.

| | |
|---|---|
| ***B65H 16/00*** | (2006.01) |
| ***B65H 16/04*** | (2006.01) |
| ***E04B 1/62*** | (2006.01) |
| ***E04G 21/16*** | (2006.01) |

(52) U.S. Cl.

CPC ..... *B65H 16/005* (2013.01); *B65H 16/04* (2013.01); *E04B 1/625* (2013.01); *E04G 21/16* (2013.01); *B65H 2301/415* (2013.01); *B65H 2405/461* (2013.01); *B65H 2408/24* (2013.01); *B65H 2701/1922* (2013.01)

(58) Field of Classification Search

CPC ..... B65H 16/005; B65H 2701/1922; B65H 16/04; B65H 2301/415; B65H 2405/461; B65H 2408/24; E04B 1/625; E04G 21/16

USPC ..... 242/599.4

See application file for complete search history.

(56) References Cited

U.S. PATENT DOCUMENTS

| | | | | |
|---|---|---|---|---|
| 2,439,681 A * | 4/1948 | Ankney | E04D 15/06 | 242/557 |
| 5,322,234 A * | 6/1994 | Robert | B65H 75/185 | 242/596.7 |
| 5,667,165 A * | 9/1997 | Gardner | B65H 35/0086 | 242/588.2 |
| 5,685,054 A * | 11/1997 | Yasnogorodskiy | B65H 16/00 | 29/446 |
| 5,725,173 A * | 3/1998 | Yasnogorodskiy | B65H 16/00 | 160/24 |
| 5,743,484 A * | 4/1998 | Baskett | E04H 9/145 | 242/596.8 |
| 6,705,059 B2 * | 3/2004 | Romes | E04F 21/18 | 52/749.12 |
| 8,528,301 B1 * | 9/2013 | Robbins | E04D 15/06 | 52/746.1 |

* cited by examiner

*Primary Examiner* — William A. Rivera

(74) *Attorney, Agent, or Firm* — The Iwashko Law Firm, PLLC; Lev Ivan Gabriel Iwashko

(57) ABSTRACT

A house wrapping device to connect to a wall of a building, the house wrapping device including a main body having an elongate shape, a wrap receiving rod perpendicularly disposed away from a first end of the main body with respect to a direction to receive a house wrap roll thereon and dispense a house wrap from the house wrap roll, and a wedge perpendicularly disposed away from a second end of the main body opposite to the first end with respect to the direction to removably connect the main body to the wall and prevent the main body from falling off the wall.

6 Claims, 2 Drawing Sheets

HOUSE WRAPPING DEVICE

BACKGROUND

1. Field

The present general inventive concept relates generally to house wrapping, and particularly, to a house wrapping device.

2. Description of the Related Art

During construction of a building, such as a house, house wrap is added on walls and/or siding to prevent moisture from entering the house. In other words, the house wrap protects an exterior of the house.

However, installing the house wrap is a tedious, time-consuming, and laborious task. Typically, at least two people must cooperate to successfully install the house wrap. In particular, a first person holds the house wrap roll while a second person fastens it to the building. Furthermore, although some people are able to do this alone, wrapping a house solo can add time and complexity to an already frustrating task.

Therefore, there is a need for a house wrapping device to facilitate house wrapping and allows a person to easily add the house wrap to the house without assistance of another person.

SUMMARY

The present general inventive concept provides a house wrapping device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a house wrapping device to connect to a wall of a building, the house wrapping device including a main body having an elongate shape, a wrap receiving rod perpendicularly disposed away from a first end of the main body with respect to a direction to receive a house wrap roll thereon and dispense a house wrap from the house wrap roll, and a wedge perpendicularly disposed away from a second end of the main body opposite to the first end with respect to the direction to removably connect the main body to the wall and prevent the main body from falling off the wall.

The wrap receiving rod may include a plurality of holding teeth disposed along at least a portion of a length of the wrap receiving rod to prevent the house wrap roll from moving away from the wrap receiving rod.

The wrap receiving rod may be movably disposed on the main body to rotate about a perpendicular axis to the main body, such that the house wrap is dispensed from the house wrap roll in response to rotation of the wrap receiving rod.

The wedge may be movably disposed in at least one of a first lateral direction and a second lateral direction on the main body.

The house wrapping device may further include a wheel disposed on at least a portion of the wedge to facilitate movement of the main body, the wrap receiving rod, and the wedge along the wall in response to an application of force thereto.

The house wrapping device may further include a wedge adjusting groove disposed within at least a portion of the main body to at least partially extend a length of the main body.

The house wrapping device may further include a wedge fastener moveably disposed on at least a portion of the main body and removably connected to at least a portion of the wedge to prevent the wedge from moving along the wedge adjusting groove in response to rotating in a first rotational direction and allow the wedge to move along the wedge adjusting groove in response to rotating in a second rotational direction.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

House Wrapping Device 100
Main Body 110
Wrap Receiving Rod 120
Holding Teeth 121
Wedge 130
Wheel 140
Wedge Adjusting Groove 150
Wedge Fastener 160
Rod Adjusting Fastener 170
House Wrapping Device 200
Main Body 210
Wrap Receiving Rod 220
Wedge 230

Figure 1:
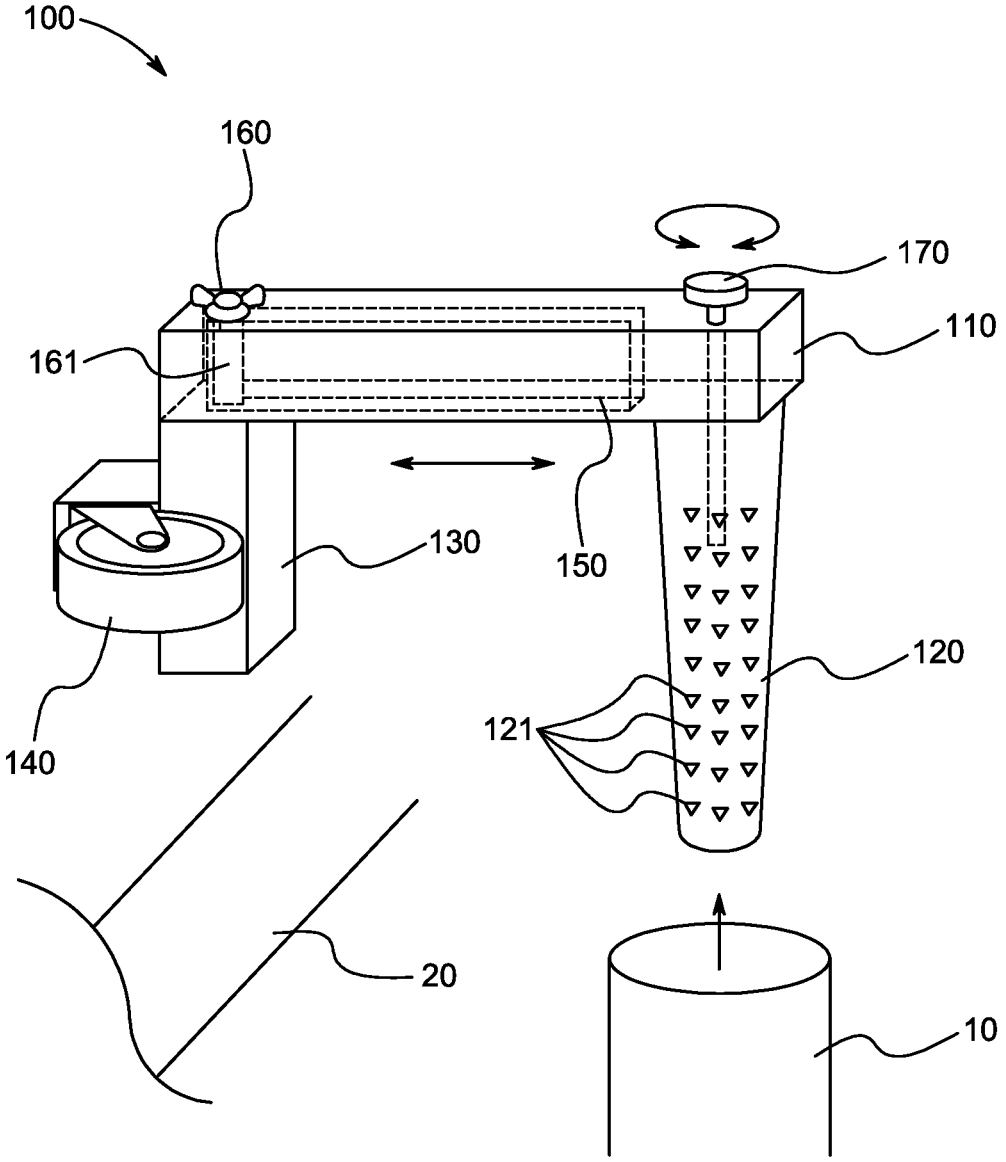
FIG. 1 illustrates a side perspective view of a house wrapping device, according to an exemplary embodiment of the present general inventive concept.

FIG. 1 illustrates a side perspective view of a house wrapping device 100, according to an exemplary embodiment of the present general inventive concept.

The house wrapping device 100 may be constructed from at least one of metal, plastic, wood, and rubber, etc., but is not limited thereto.

The house wrapping device 100 may include a main body 110, a wrap receiving rod 120, a wedge 130, a wheel 140, a wedge adjusting groove 150, a wedge fastener 160, and a rod adjusting fastener 170, but is not limited thereto.

The main body 110 may have an elongate shape. Moreover, the main body 110 may have a length corresponding to a size of a wall 20 of a building (e.g., a house), such that the main body 110 may be at least equivalent and/or exceed the length of the wall 20. For example, the length of the main body 110 may be based on a 2×4 surface and/or a 2×6 (e.g., surface block of wood and/or metal, such as the wall 20).

Referring to FIG. 1, the wrap receiving rod 120 is illustrated to have a conical shape. However, the wrap receiving rod 120 may be rectangular, cylindrical, triangular, pentagonal, hexagonal, heptagonal, octagonal, or any other shape known to one of ordinary skill in the art, but is not limited thereto.

The wrap receiving rod 120 may be perpendicularly disposed away from a first end of the main body 110 with respect to a direction. Additionally, the wrap receiving rod 120 may be movably (i.e., rotatably) disposed on the main body 110. The wrap receiving rod 120 may receive a house wrap roll 10 thereon.

The wrap receiving rod 120 may include a plurality of holding teeth 121, but is not limited thereto.

The plurality of holding teeth 121 may be disposed along at least a portion of a length of the wrap receiving rod 120. Also, the plurality of holding teeth 121 may be disposed along an entirety of the wrap receiving rod 120. Moreover, each of the plurality of holding teeth 121 may at least partially protrude away from the wrap receiving rod 120. As such, the plurality of holding teeth 121 may prevent the house wrap roll 10 from moving away (i.e., falling off) from the wrap receiving rod 120. Accordingly, the plurality of holding teeth 121 may penetrate into the house wrap roll 10.

Furthermore, the wrap receiving rod 120 may be laminated with an adhesive (e.g., tape, glue) to increase adhesion of the house wrap roll 10 to the wrap receiving rod 120.

The wedge 130 may be perpendicularly disposed away from a second end of the main body 110 opposite to the first end with respect to the direction. Additionally, the wedge 130 may be movably (i.e., slidably) disposed on the main body 110. The wedge 130 may form a hook, such that the wedge 130 and/or the main body 110 may removably connect to (i.e., be disposed on) at least a portion of the wall 20. Thus, the wedge 130 may prevent the main body 110 from falling off the wall 20. Collectively, the wedge 130, the main body 110, and/or the wrap receiving rod 120 may form a U-shape that surrounds the wall 20 while disposed on the wall 20.

The wheel 140 may be disposed on at least a portion of the wedge 130. The wheel 140 may facilitate movement of the main body 110, the wrap receiving rod 120, and/or the wedge 130 along the wall 20. More specifically, the wheel 140 may rotate in response to an application of force (e.g., pushing, pulling) against the main body 110, the wrap receiving rod 120, the wedge 130, and/or the wheel 140.

During use, the main body 110, the wrap receiving rod 120, and/or the wedge 130 may move in a lateral direction along the wall 20 using the wheel 140. Moreover, the wrap receiving rod 120 may rotate in a first rotational direction (i.e., clockwise) or a second rotational direction (i.e., counterclockwise) to dispense (i.e., unwrap) the house wrap roll 10, such that the house wrap roll 10 may cover the wall 20 with house wrap.

The wedge adjusting groove 150 may be disposed within at least a portion of the main body 110. The wedge adjusting groove 150 may at least partially extend the length of the main body 110. In other words, the wedge adjusting groove 150 may have a length at least a portion of the length of the main body 110 and/or an entirety of the length of the main body 110.

Referring again to FIG. 1, the wedge fastener 160 is illustrated to be a wing nut. However, the wedge fastener 160 may be a screw, a bolt, a nut, a nail, a clamp, a clasp, a magnet, and/or any combination thereof, but is not limited thereto.

The wedge fastener 160 may be moveably (i.e., rotatably) disposed on at least a portion of the main body 110. The wedge fastener 160 may be removably connected to at least a portion of the wedge 130 with a connecting rod 161 through the wedge adjusting groove 150. The wedge fastener 160 may prevent (e.g., tighten) the wedge 130 from moving along the wedge adjusting groove 150 in response to rotating in the first rotational direction or the second rotational direction. Conversely, the wedge fastener 160 may allow (e.g., loosen) the wedge 130 to move along the wedge adjusting groove 150 in response to rotating in the second rotational direction or the first rotational direction.

Accordingly, the wedge 130 may be adjusted along the length of the wedge adjusting groove 150 to accommodate the size of the wall 20 as described above. The wedge 130 may move in a first lateral direction and/or a second lateral direction along the length of the wedge adjusting groove 150.

The rod adjusting fastener 170 may be moveably (i.e., rotatably) disposed on at least a portion of the main body 110. Additionally, the rod adjusting fastener 170 may be removably connected to at least a portion of the wrap receiving rod 120. The rod adjusting fastener 170 may allow the wrap receiving rod 120 to rotate about a perpendicular axis to the main body 110. Thus, the wrap receiving rod 120 may rotate to allow the house wrap roll 10 to dispense the house wrap.

Therefore, the house wrapping device 100 may facilitate installation of the house wrap by one user without assistance of another person. Also, the house wrapping device 100 may reduce a time required for installation of the house wrap.

Figure 2:
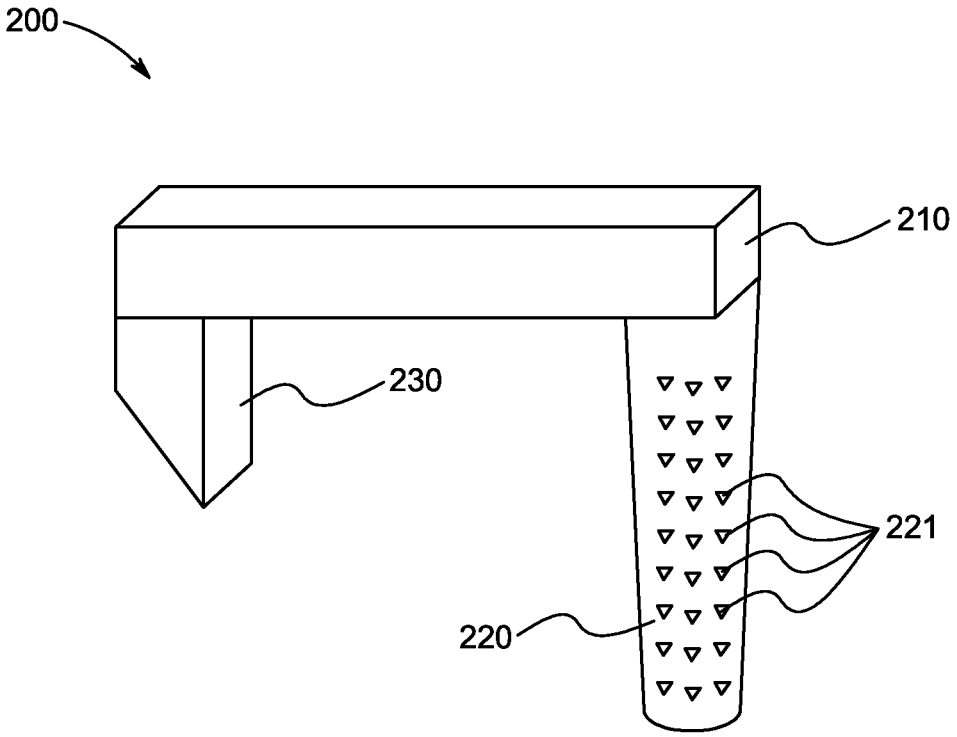
FIG. 2 illustrates a side perspective view of a house wrapping device, according to another exemplary embodiment of the present general inventive concept.

FIG. 2 illustrates a side perspective view of a house wrapping device 200, according to another exemplary embodiment of the present general inventive concept.

The house wrapping device 200 may be constructed from at least one of metal, plastic, wood, and rubber, etc., but is not limited thereto.

The house wrapping device 200 may include a main body 210, a wrap receiving rod 220, and a wedge 230, but is not limited thereto.

The main body 210 may have an elongate shape. Moreover, the main body 210 may have a length corresponding to a size of a wall 20 of a building (e.g., a house), such that the main body 210 may be at least equivalent and/or exceed the length of the wall 20. For example, the length of the main body 210 may be based on a 2×4 surface and/or a 2×6 (e.g., surface block of wood and/or metal, such as the wall 20).

Referring to FIG. 2, the wrap receiving rod 220 is illustrated to have a conical shape. However, the wrap receiving rod 220 may be rectangular, cylindrical, triangular, pentagonal, hexagonal, heptagonal, octagonal, or any other shape known to one of ordinary skill in the art, but is not limited thereto.

The wrap receiving rod 220 may be perpendicularly disposed away from a first end of the main body 210 with respect to a direction. The wrap receiving rod 220 may receive a house wrap roll 10 thereon.

The wrap receiving rod 220 may include a plurality of holding teeth 221, but is not limited thereto.

The plurality of holding teeth 221 may be disposed along at least a portion of a length of the wrap receiving rod 220. Also, the plurality of holding teeth 221 may be disposed along an entirety of the wrap receiving rod 220. Moreover, each of the plurality of holding teeth 221 may at least partially protrude away from the wrap receiving rod 220. As such, the plurality of holding teeth 221 may prevent the house wrap roll 10 from moving away (i.e., falling off) from the wrap receiving rod 220. Accordingly, the plurality of holding teeth 221 may penetrate into the house wrap roll 10.

Furthermore, the wrap receiving rod 220 may be laminated with an adhesive (e.g., tape, glue) to increase adhesion of the house wrap roll 10 to the wrap receiving rod 220.

The wedge 230 may be perpendicularly disposed away from a second end of the main body 210 opposite to the first end with respect to the direction. The wedge 230 may form a hook, such that the wedge 230 and/or the main body 210 may removably connect to (i.e., be disposed on) at least a portion of the wall 20. Thus, the wedge 230 may prevent the main body 210 from falling off the wall 20. Collectively, the wedge 230, the main body 210, and/or the wrap receiving rod 220 may form a U-shape that surrounds the wall 20 while disposed on the wall 20.

During use, the main body 210, the wrap receiving rod 220, and/or the wedge 230 may move in a lateral direction along the wall 20 in response to an application of force (e.g., pushing, pulling), such that the main body 210, the wrap receiving rod 220, and/or the wedge 230 moves (i.e., slides) along the wall 20. Moreover, the wrap receiving rod 220 may dispense (i.e., unwrap) the house wrap roll 10, such that the house wrap roll 10 may cover the wall 20 with house wrap.

It is important to note that the house wrapping device 200 may differ from the house wrapping device 100 by being fixed in size rather than adjustable. However, both devices may perform the same service based on a preference of the user.

The present general inventive concept may include a house wrapping device 100 to connect to a wall 20 of a building, the house wrapping device 100 including a main body 110 having an elongate shape, a wrap receiving rod 120 perpendicularly disposed away from a first end of the main body 110 with respect to a direction to receive a house wrap roll 10 thereon and dispense a house wrap from the house wrap roll 10, and a wedge 130 perpendicularly disposed away from a second end of the main body 110 opposite to the first end with respect to the direction to removably connect the main body 110 to the wall 20 and prevent the main body 110 from falling off the wall 20.

The wrap receiving rod 120 may include a plurality of holding teeth 121 disposed along at least a portion of a length of the wrap receiving rod 120 to prevent the house wrap roll 10 from moving away from the wrap receiving rod 120.

The wrap receiving rod 120 may be movably disposed on the main body 110 to rotate about a perpendicular axis to the main body 110, such that the house wrap is dispensed from the house wrap roll 10 in response to rotation of the wrap receiving rod 120.

The wedge 130 may be movably disposed in at least one of a first lateral direction and a second lateral direction on the main body 110.

The house wrapping device 100 may further include a wheel 140 disposed on at least a portion of the wedge 130 to facilitate movement of the main body 110, the wrap receiving rod 120, and the wedge 130 along the wall 20 in response to an application of force thereto.

The house wrapping device 100 may further include a wedge adjusting groove 150 disposed within at least a portion of the main body 110 to at least partially extend a length of the main body 110.

The house wrapping device 100 may further include a wedge fastener 160 moveably disposed on at least a portion of the main body 110 and removably connected to at least a portion of the wedge 130 to prevent the wedge 130 from moving along the wedge adjusting groove 150 in response to rotating in a first rotational direction and allow the wedge 130 to move along the wedge adjusting groove 150 in response to rotating in a second rotational direction.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A house wrapping device to connect to a wall of a building, the house wrapping device comprising:

a main body having an elongate shape;

a wrap receiving rod perpendicularly disposed away from a first end of the main body with respect to a direction to receive a house wrap roll thereon and dispense a house wrap from the house wrap roll;

a wedge perpendicularly disposed away from a second end of the main body opposite to the first end with respect to the direction to removably connect the main body to the wall and prevent the main body from falling off the wall; and a wedge adjusting groove disposed within at least a portion of the main body to at least partially extend a length of the main body.

2. The house wrapping device of claim 1, wherein the wrap receiving rod comprises:

a plurality of holding teeth disposed along at least a portion of a length of the wrap receiving rod to prevent the house wrap roll from moving away from the wrap receiving rod.

3. The house wrapping device of claim 1, wherein the wrap receiving rod is movably disposed on the main body to rotate about a perpendicular axis to the main body, such that the house wrap is dispensed from the house wrap roll in response to rotation of the wrap receiving rod.

4. The house wrapping device of claim 1, wherein the wedge is movably disposed in at least one of a first lateral direction and a second lateral direction on the main body.

5. The house wrapping device of claim 1, further comprising:

a wheel disposed on at least a portion of the wedge to facilitate movement of the main body, the wrap receiving rod, and the wedge along the wall in response to an application of force thereto.

6. The house wrapping device of claim 1, further comprising:

a wedge fastener moveably disposed on at least a portion of the main body and removably connected to at least a portion of the wedge to prevent the wedge from moving along the wedge adjusting groove in response to rotating in a first rotational direction and allow the wedge to move along the wedge adjusting groove in response to rotating in a second rotational direction.

* * * * *